US010077909B2

(12) United States Patent
Koo et al.

(10) Patent No.: US 10,077,909 B2
(45) Date of Patent: Sep. 18, 2018

(54) OUTDOOR UNIT OF AIR CONDITIONER

(71) Applicant: LG ELECTRONICS INC., Seoul (KR)

(72) Inventors: Kyomin Koo, Seoul (KR); Sangyoung Kwon, Seoul (KR); Hoki Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 34 days.

(21) Appl. No.: 15/301,234

(22) PCT Filed: Dec. 30, 2015

(86) PCT No.: PCT/KR2015/014522

§ 371 (c)(1),
(2) Date: Sep. 30, 2016

(87) PCT Pub. No.: WO2016/108643

PCT Pub. Date: Jul. 7, 2016

(65) Prior Publication Data

US 2017/0016636 A1 Jan. 19, 2017

(30) Foreign Application Priority Data

Dec. 30, 2014 (KR) ..... 10-2014-0194311

(51) Int. Cl.

| | |
|---|---|
| ***F24F 13/20*** | (2006.01) |
| ***F24F 1/22*** | (2011.01) |
| ***F24F 1/24*** | (2011.01) |
| ***F24F 13/30*** | (2006.01) |
| *F24F 13/24* | (2006.01) |

(52) U.S. Cl.

CPC ..... *F24F 1/22* (2013.01); *F24F 1/24* (2013.01); *F24F 13/20* (2013.01); *F24F 13/30* (2013.01); *F24F 2013/242* (2013.01)

(58) Field of Classification Search

CPC ... F25D 23/003; F24F 1/02; F24F 1/22; F24F 1/24; F24F 1/26; F24F 1/56; F24F 1/40; F24F 1/50

USPC ..... 62/428, 498, 509, 173, 259.1, 508

See application file for complete search history.

(56) References Cited

U.S. PATENT DOCUMENTS

| | | | | |
|---|---|---|---|---|
| 2008/0053118 | A1* | 3/2008 | Park | F24F 5/001 62/129 |
| 2008/0053141 | A1* | 3/2008 | Kim | F24F 3/06 62/434 |
| 2009/0077988 | A1* | 3/2009 | Ishikawa | F24F 1/22 62/259.1 |
| 2009/0137197 | A1* | 5/2009 | Jang | F24F 1/22 454/184 |

FOREIGN PATENT DOCUMENTS

| | | | |
|---|---|---|---|
| JP | 5-296496 | A | 11/1993 |
| JP | 2007-198703 | A | 8/2007 |
| KR | 20-0135808 | Y1 | 3/1999 |
| KR | 10-2009-0031133 | A | 3/2009 |
| KR | 10-1448987 | B1 | 10/2014 |

* cited by examiner

*Primary Examiner* — Melvin Jones
(74) *Attorney, Agent, or Firm* — Dentons US LLP

(57) ABSTRACT

An outdoor unit of an air conditioner according to one embodiment of the present invention includes a case; and a control box installed in the case, wherein a stepped portion protrudes from an upper surface of the control box, and a plurality of air outlet ports are formed at the stepped portion.

13 Claims, 5 Drawing Sheets

[Fig. 1]
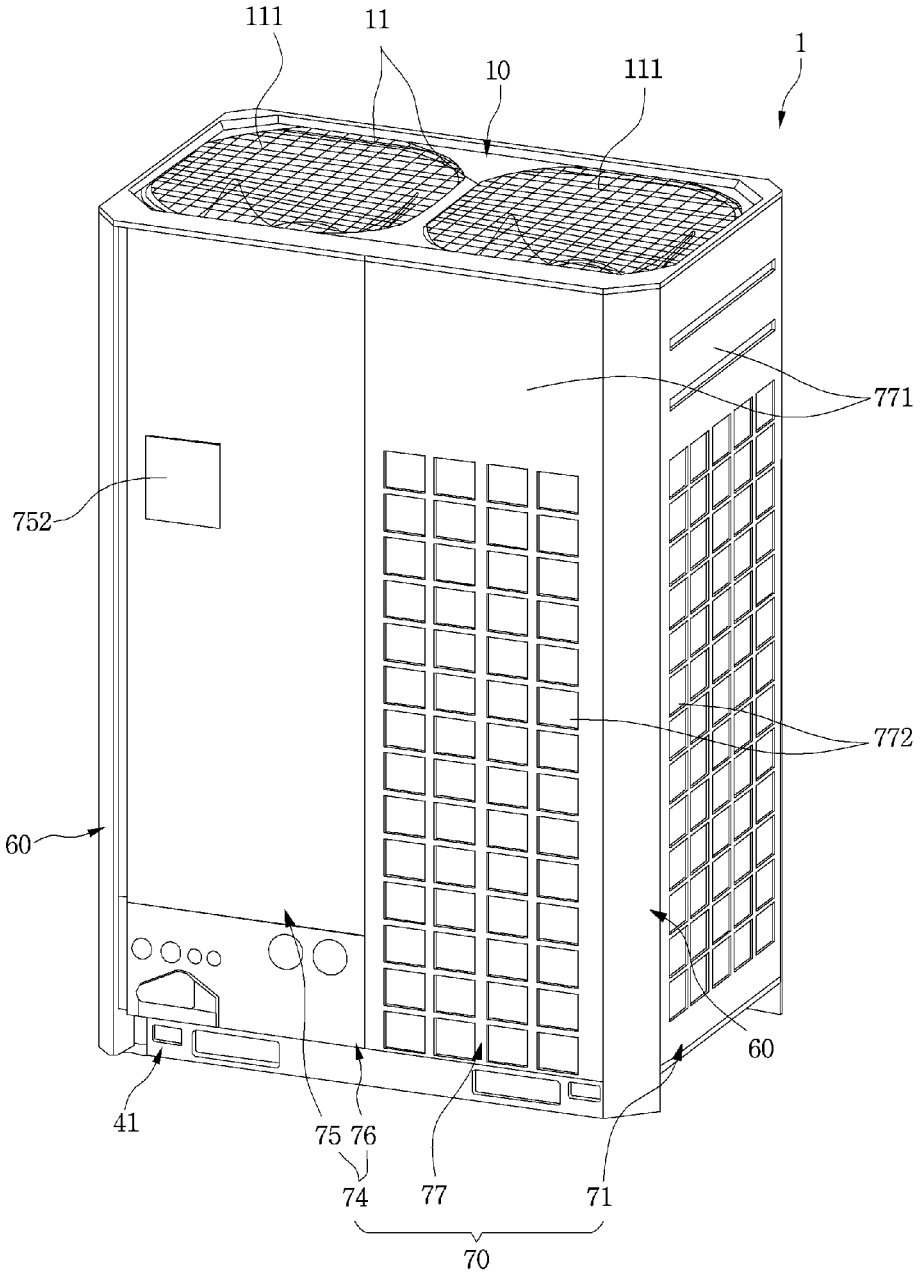

[Fig. 2]
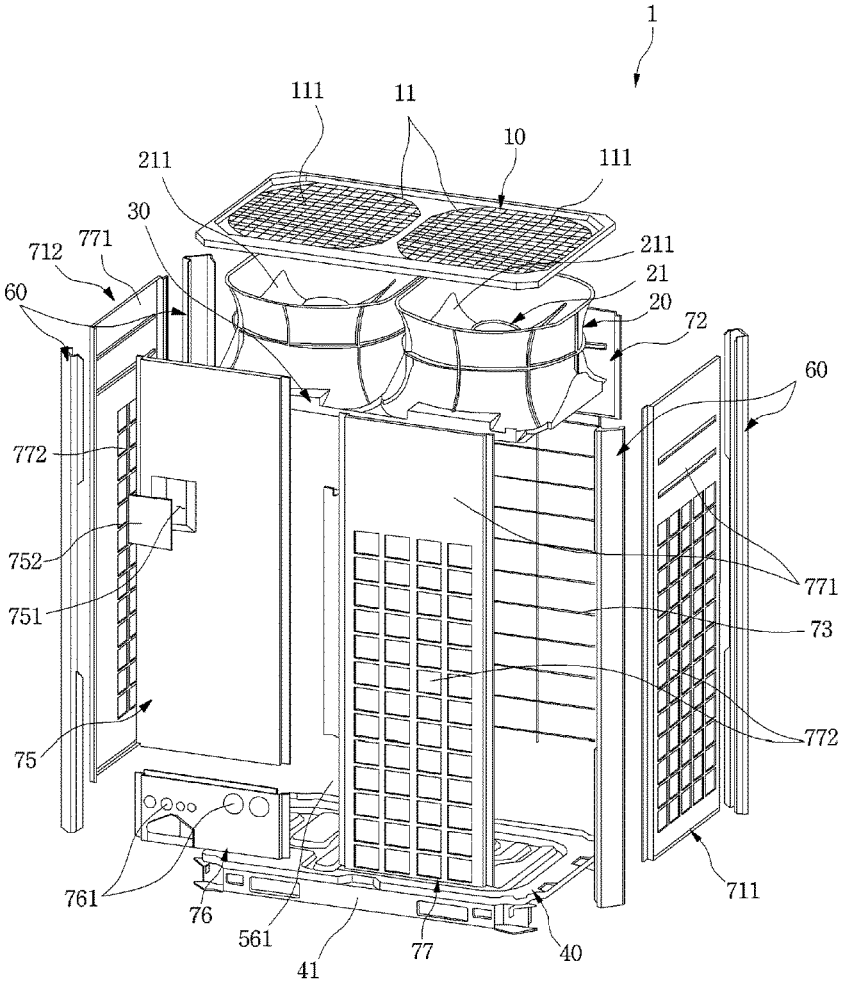
[Fig. 3]
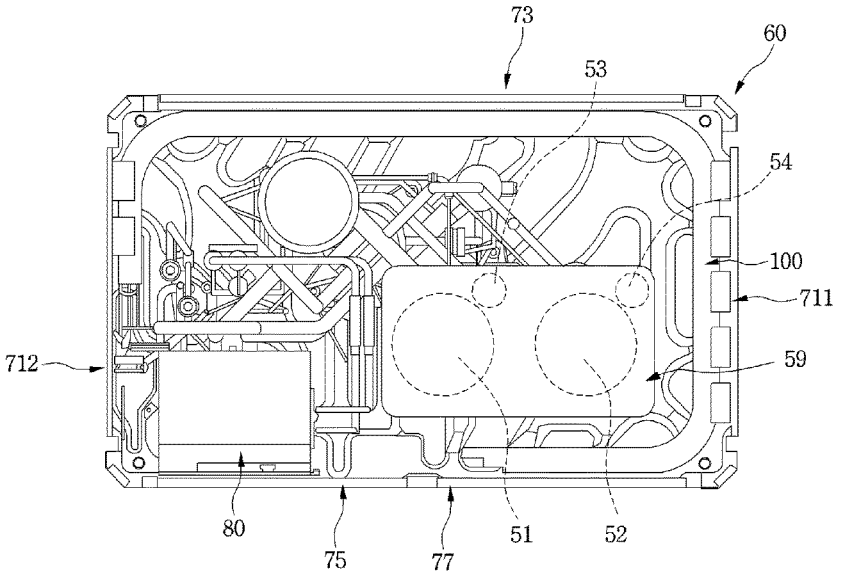

[Fig. 4]
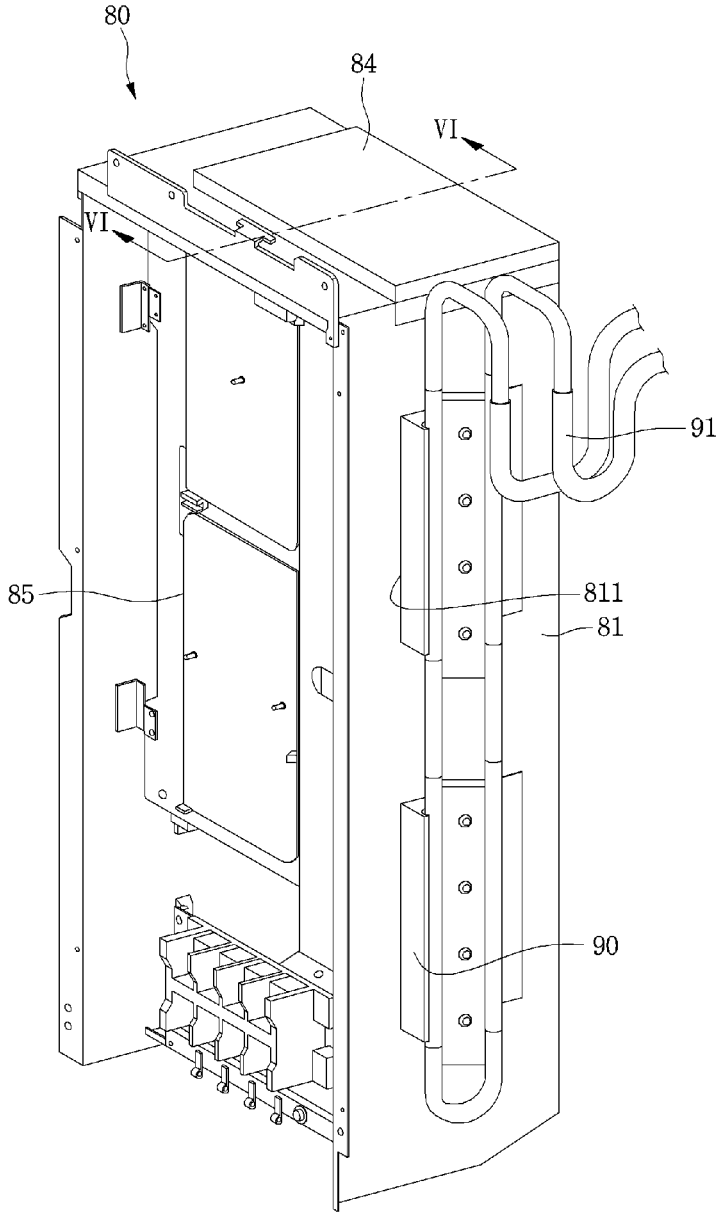

[Fig. 5]
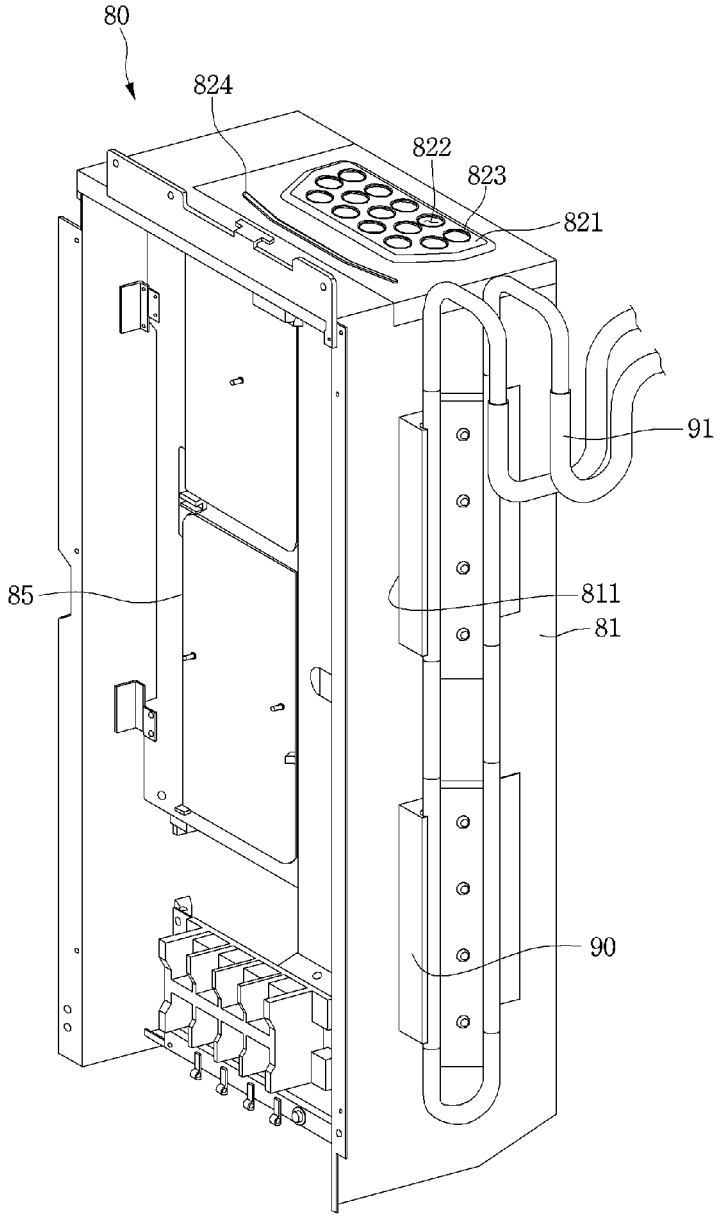

[Fig. 6]
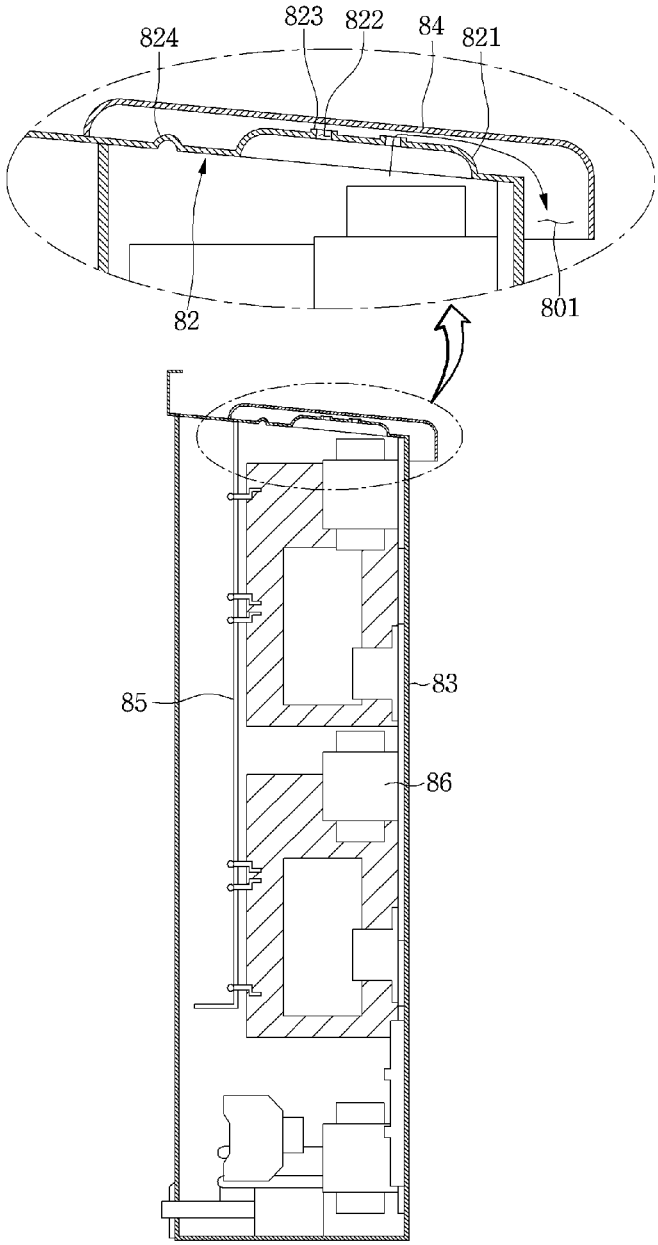

OUTDOOR UNIT OF AIR CONDITIONER

This application is a National Stage Application of International Application No. PCT/KR2015/014522, filed on Dec. 30, 2015, which claims the benefit of Korean Patent Application No. 10-2014-0194311, filed on Dec. 30, 2014, all of which are hereby incorporated by reference in their entirety for all purposes as if fully set forth herein.

TECHNICAL FIELD

The present invention relates to an outdoor unit of an air conditioner.

BACKGROUND ART

An air conditioner is a home appliance which maintains indoor air in an optimal state according to uses and purposes thereof. For example, the interior is controlled to a cooling state in summer, and controlled to a warming state in winter, and humidity of the interior is also controlled, and the indoor air is maintained in a fresh and clean state.

Specifically, the air conditioner is driven in a refrigeration cycle in which compression, condensation, expansion and evaporation processes of a refrigerant are performed, and thus a cooling and warming operation of an interior space may be performed.

According to whether an indoor unit and an outdoor unit are separated, the air conditioner may be classified into a separated type air conditioner in which the indoor unit and the outdoor unit are separated from each other, and an integrated type air conditioner in which the indoor unit and the outdoor unit are integrated in one unit. The outdoor unit includes an outdoor heat exchanger which heat-exchanges with external air, and the indoor unit includes an indoor heat exchanger which heat-exchanges with indoor air.

When the refrigeration cycle performs the cooling operation, the outdoor heat exchanger serves as a condenser, and the indoor heat exchanger serves as an evaporator. However, when the refrigeration cycle performs the warming operation, the indoor heat exchanger serves as the condenser, and the outdoor heat exchanger serves as the evaporator.

Meanwhile, recently, a multi-type air conditioner having a refrigerant circuit in which a plurality of outdoor units are disposed at an outside such as a rooftop of a building, and a plurality of indoor units are respectively connected with the outdoor units to independently cool or warm each interior space is used widely.

In Korean Unexamined Patent Application Publication No. 10-2009-0031133, there is disclosed a structure of a control box.

DISCLOSURE OF INVENTION

Technical Problem

The present invention is directed to providing an outdoor unit of an air conditioner, in which an air discharge port is formed at an upper surface of a control box, and rainwater is prevented from being introduced into the control box through the air discharge port.

Solution to Problem

One aspect of the present invention provides an outdoor unit of an air conditioner, including a case; and a control box installed in the case, wherein a stepped portion protrudes from an upper surface of the control box, and a plurality of air outlet ports are formed at the stepped portion.

A sleeve may protrude upward along an edge of each of the air outlet ports.

Additionally, a blocking rib may be formed at a front of the stepped portion, and the stepped portion and the blocking rib may be shielded by an upper cover.

A rear end of the upper cover may be bent downward along a rear surface of the control box to form an exhaust path.

Advantageous Effects of Invention

According to the outdoor unit of the air conditioner in accordance with the embodiment of the present invention having a structure such as above, rainwater introduced into the outdoor unit can be prevented from being introduced into the control box.

BRIEF DESCRIPTION OF DRAWINGS

FIG. 1 is a perspective view of an outdoor unit of an air conditioner according to an embodiment of the present invention.

FIG. 2 is an exploded perspective view of the outdoor unit.

FIG. 3 is a plan view illustrating an inside of the outdoor unit.

FIG. 4 is a perspective view of a control box according to an embodiment of the present invention.

FIG. 5 is a partial perspective view of the control box from which an upper cover is removed.

FIG. 6 is a longitudinal cross-sectional view taken along VI-VI of FIG. 4.

MODE FOR THE INVENTION

Hereinafter, exemplary embodiments of the present invention will be described in detail. However, the present invention is not limited to the exemplary embodiments disclosed below, but may be implemented in various forms. The following exemplary embodiments are described in order to enable those of ordinary skill in the art to embody and practice the invention.

FIG. 1 is a perspective view of an outdoor unit of an air conditioner according to an embodiment of the present invention, FIG. 2 is an exploded perspective view of the outdoor unit, and FIG. 3 is a plan view illustrating an inside of the outdoor unit.

Referring to FIGS. 1 to 3, an outdoor unit 1 of an air conditioner according to an embodiment of the present invention includes a base pan 40 which forms a bottom surface, an out panel 70 which is coupled to be upright on an edge of the base pan 40, and a cover plate 10 which covers an upper surface of the out panel 70.

Specifically, one pair of discharge ports 11 may be formed at the cover plate 10. A discharge grille 111 is installed at the discharge ports 11 to prevent foreign substances from being introduced from an outside into the outdoor unit 1 through the discharge ports 11.

Meanwhile, side supporters 60 are provided at four corners of the outdoor unit 1. Each of the side supporters 60 may be formed to be bent to be able to form each corner portion of the outdoor unit 1, and may be formed in a pipe shape.

The out panel 70 is provided between the side supporters 60, and forms an external appearance of the outdoor unit 1.

Specifically, the out panel 70 may include side panels 71 which form left and right side surfaces of the outdoor unit 1, a front panel 74 which forms a front surface of the outdoor unit 1, and a rear panel 72 which forms a rear surface of the outdoor unit 1. By the side supporters 60, the front panel 74 may be connected to the side panels 71, and the rear panel 72 may be connected to the side panels 71.

Specifically, the side panels 71 form a left side surface and a right side surface of an outdoor heat exchanger 100, and may be formed in a plate shape which connects edges of the side supporter 60, the base pan 40 and the cover plate 10 with each other.

A shielding part 771 may be formed at an upper area of each of the side panels 71, and a plurality of suction ports 772 may be formed at a lower area of the shielding part 771. The shielding part 771 is defined in an area corresponding to an installation position of a shroud 20 for guiding discharged air, and may be formed to surround the shroud 20.

The plurality of suction ports 772 is formed at an area of the outdoor heat exchanger 100 which exchanges heat with suctioned air, and the air introduced into the outdoor unit 1 through the plurality of suction ports 772 exchanges heat with a refrigerant while passing through the outdoor heat exchanger 100.

The suction ports 772 formed at a right side panel 711 of the side panels 71, which forms the right surface (when seen in FIG. 2) of the outdoor heat exchanger 1, may be formed at an entire area of the right side panel 711 except the shielding part 771. However, the suction ports 772 formed at a left side panel 712 of the side panels 71, which forms the left surface (when seen in FIG. 2) of the outdoor heat exchanger 1, may be formed at other areas thereof except the shielding part 771 and a part of a front area of the left side panel 712.

In other words, the suction ports 772 of the left side panel 712 are formed at only the area to which the outdoor heat exchanger 100 extends, so that the outdoor air exchanges heat with the outdoor heat exchanger 100. And the suction ports 772 are not formed at the front area of the left side panel 712, in which elements forming a refrigeration cycle are concentrated, so that the elements forming the refrigeration cycle are shielded.

Meanwhile, the rear panel 72 is installed at the rear surface of the outdoor unit 1 corresponding to a portion in which the shroud 20 and a fan motor assembly 21 are located. A suction grille 73 may be installed at a space between a lower end of the rear panel 72 and the base pan 40. That is, an upper end of the suction grille 73 may be connected to the lower end of the rear panel 72, and a lower end of the suction grille 73 may be put on the base pan 40. The suction grille 73 may be defined as an assembly of a plurality of wires connected in the form of a grid. Therefore, the suction grille 73 serves to protect the outdoor heat exchanger 100 from external shocks or foreign substances, and also to enable the external air to be smoothly introduced.

Of course, the embodiment of the present invention has been described such that the rear surface of the outdoor unit 1 is formed by the rear panel 72 and the suction grille 73, but the rear surface of the outdoor unit 1 may be formed to have the same shape as the side panels 71.

The front panel 74 is provided at the front surface of the outdoor unit 1. The front panel 74 may include a service panel 75, a pipe panel 76 and a suction panel 77.

Specifically, a left side of the front surface of the outdoor unit 1 may be shielded by the service panel 75 and the pipe panel 76, and a right side of the front surface of the outdoor unit 1 may be shielded by the suction panel 77.

The service panel 75 covers a left area of the outdoor unit 1, and all of the panels of the front panel 74 are formed to be independently separable from each other while being assembled. Accordingly, only the service panel 75 may be separated to allow an access to internal elements of the outdoor unit 1.

In particular, when the service panel 75 is opened, an overall control box 80 may be exposed toward a front side, and thus access to each element forming the refrigeration cycle and a refrigerant pipe connecting the elements with each other may be allowed.

Meanwhile, a service door 752 may be further provided at the service panel 75. The service door 752 may independently open and close a service window 751 formed at the service panel 75. The service window 751 may be formed at a position at which some of main elements of the control box 80 requiring frequent verification and operation are located. Therefore, when a user or an operator intends to check whether the air conditioner is normal or abnormal or to set a new operating condition, it is possible to access to the main elements in the control box 80 and to perform a desired operation by only opening the service door 752 without separating the entire service panel 75.

The pipe panel 76 is provided between a lower end of the service panel 75 and the base pan 40 to allow a connection pipe for connecting the outdoor unit 1 with the indoor unit 2 to pass therethrough and to be fixed thereto. The pipe panel 76 is formed to have the same width as that of the service panel 75, and the service panel 75 may be separated in a state in which the pipe panel 76 is fixed to the base pan 40.

A pipe installation hole 761 through which a plurality of indoor unit connection pipes connected to the indoor unit pass is formed at the pipe panel 76. A service valve is installed at the refrigerant pipe, which passes through the pipe installation hole 761 from an inside of the outdoor unit 1 and is exposed to an outside of the outdoor unit 1, to allow the indoor unit connection pipes connected with the indoor unit to be easily connected and installed. If necessary, the pipe panel 76 may be integrally formed with the service panel 75.

Meanwhile, the suction panel 77 is formed to cover an exterior of a right front surface of the outdoor unit 1 except the service panel 75 and the pipe panel 76, and also to shield the outdoor heat exchanger 100 disposed at the front surface of the outdoor unit 1. Accordingly, an upper end of the suction panel 77 may be in contact with the cover plate 10, and a lower end thereof may be put on the base pan 40. Additionally, a left end of the suction panel 77 is in contact with the service panel 75 and the pipe panel 76, and a right end thereof is in contact with the side supporter 60.

The suction ports 772 and the shielding part 771 may also be formed at the suction panel 77. That is, the shielding part 771 may be formed at an area which shields the shroud 20, and the suction ports 772 may be formed at an area corresponding to a front area of the outdoor heat exchanger 100 to allow the external air to be introduced toward the outdoor heat exchanger 100.

Meanwhile, the shroud 20 is installed at an internal upper portion of the outdoor unit 1, and the fan motor assembly 21 is accommodated in the shroud 20. The shroud 20 is an element which guides air suctioned into the outdoor unit 1 to be discharged in an upper direction of the outdoor unit 1. Therefore, the shroud 20 is formed so that upper and lower ends thereof are open and a cross-sectional width thereof is gradually reduced from the lower and upper ends toward a center portion thereof. The discharge port 11 is formed to have the same shape as or a similar shape to that of the open upper surface of the shroud 20, and thus when the air is discharged through the discharge port 11, flow resistance may be minimized.

The fan motor assembly 21 includes a motor and a fan 211, and is disposed inside the shroud 20 to forcibly discharge the air introduced into the outdoor unit 1. Although not illustrated in detail, the fan motor assembly 21 may be seated on a mounting member 30, and the shroud 20 may also be seated on the mounting member 30, and then may be fixed to the internal upper portion of the outdoor unit 1. To this end, the mounting member 30 may be coupled to one side of the out panel 70 forming the side surface of the outdoor unit 1.

A lower surface of the outdoor unit 1 is defined by the base pan 40. Specifically, the base pan 40 may be maintained in a spaced state from an installation surface by a base frame 41. Also, the outdoor heat exchanger 100, compressors 51 and 52 or the like forming the refrigeration cycle may be disposed on an upper surface of the base pan 40.

Specifically, the compressors 51 and 52 may be located at a front portion of the base pan 40. The compressors 51 and 52 are elements which enable a gas refrigerant to be compressed to a high temperature and high pressure state, and include a constant speed compressor which performs compressing with a constant capacity while rotating at a constant speed, and an inverter compressor of which a rotating speed is varied to control a compression capacity depending on a load. The constant speed compressor and the inverter compressor may be referred to as a first compressor 51 and a second compressor 52, respectively.

A first oil separator 53 and a second oil separator 54 which separate oil contained the refrigerant discharged from the compressors 51 and 52 are provided at the refrigerant pipe, which is connected to each outlet port of the compressors 51 and 52.

Meanwhile, the first compressor 51, the second compressor 52, the first oil separator 53 and the second oil separator 54 may be shielded by a noise shield 59. The noise shield 59 is for shielding a noise generated when the first compressor 51, the second compressor 52, the first oil separator 53 and the second oil separator 54 are operated, and may be a noise absorption material or a noise insulation material which surrounds the first compressor 51, the second compressor 52, the first oil separator 53 and the second oil separator 54.

FIG. 4 is a perspective view of the control box according to an embodiment of the present invention, FIG. 5 is a partial perspective view of the control box from which an upper cover is removed, and FIG. 6 is a longitudinal cross-sectional view taken along VI-VI of FIG. 4.

Referring to FIGS. 4 to 6, the control box 80 according to the embodiment of the present invention may be installed at a rear surface of the service panel 75 of the outdoor unit 1.

Specifically, the control box 80 may be disposed at a position corresponding to the service window 751 formed at the service panel 75. A front surface of the control box 80 is open, and the open front surface is aligned with the service window 751. Therefore, when the service door 752 is separated from the service window 751, access to an inside of the control box 80 is possible.

Additionally, a lower surface of the control box 80 may be open, and thus the external air introduced into the outdoor unit 1 may cool heat generating components in the control box 80 while being introduced into the control box 80 and flowing upward.

More specifically, the control box 80 may be formed by side surfaces 81, a rear surface 83 and an upper surface 82. A circuit board and a plurality of control components mounted on the circuit board may be accommodated in the control box 80. A part of a plurality of control components may be the heat generating components which generates high temperature heat. For example, the heat generating components include a plurality of electrical components 86 including a power module including an intelligent power module, a magnet switch, a terminal block, a reactor, a noise filter, and so on, and these components may be installed inside the control box 80.

Also, an internal cover 85 may be provided inside the control box 80 to prevent the electrical components 86 from being directly exposed to an outside. That is, even when the service door 752 is opened, the electrical components 86 may not be directly exposed, and the electrical components 86 may be exposed only when the internal cover 85 is separated.

Also, a radiation plate 90 may be installed separately on at least one side of both side surfaces of the control box 80 to rapidly cool the electrical components having a high heat value.

Specifically, one or a plurality of radiation holes 811 may be formed at the side surface of the control box 80, and the radiation plate 90 may be installed at the radiation hole 811. electrical components may be mounted on one surface of the radiation plate 90 which is directed to the inside of the control box 80, and a cooling pipe 91 or a heat pipe may be installed at the other side which is exposed to an outside of the control box 80 to transfer the heat generated from the electrical components to the cooling pipe 91.

Meanwhile, a plurality of outlet ports 822 are formed at the upper surface 82 of the control box 82 so that the air introduced into the control box 80 is discharged to the outside. Specifically, the air introduced through the lower surface of the control box 80 exchanges heat with the electrical components in the control box 80 and is heated. The heated air is light, and thus flows upward toward the upper surface 82 of the control box 80, and is discharged to the outside of the control box 80 through the plurality of outlet ports 822.

The outdoor unit 1 may be installed outdoors or may be disposed at a separate indoor storage room. When the outdoor unit 1 is installed outdoors, rainwater may be introduced through the discharge ports 11 formed at the upper surface of the outdoor unit 1. In this case, even though the control box 80 is installed inside of the control box 80, the rainwater may be introduced into the control box 80.

To prevent rainwater from being introduced into the control box 80 and causing an electrical problem or a fire, the rainwater should be prevented from flowing into the control box 80 through the outlet ports 822 of the control box 80.

To this end, the control box 80 according to the embodiment of the present invention is characterized by having the following structure for preventing introduction of rainwater.

First, the upper surface 82 is formed to be inclined downward from a front end thereof toward a rear end thereof, such that rainwater dripped on the upper surface 82 rapidly flows down.

Second, a portion at which the outlet ports 822 are formed is formed in a stepped portion 821 which protrudes upward from the upper surface 82. Accordingly, rainwater dripped on the upper surface 82 is prevented from being introduced into the discharge ports 822.

Third, a blocking rib 824 for blocking rainwater is formed between the front end of the upper surface 82 and the stepped portion 821. Therefore, rainwater flowing from the front end of the upper surface 82 toward the rear end thereof is blocked by the blocking rib 824, and thus flows toward left and right edges of the control box 80 instead of the stepped portion 821.

The blocking rib 824 may be formed to be inclined from a center portion thereof toward an end thereof in a direction of the rear end of the control box 80. In other words, a distance from the center portion of the blocking rib 824 to the front end of the control box 80 may be formed shorter than a distance from each of both ends of the blocking rib 824 to the front end of the control box 80.

Fourth, a sleeve 823 extends from an edge of each of the outlet ports 822 by a predetermined height. Therefore, even when rainwater flows to an upper surface of the stepped portion 821, the rainwater cannot be introduced toward the outlet ports 822.

Fifth, the upper surface 82 may be covered by an upper cover 84 to prevent rainwater from being introduced into the control box 80.

Specifically, the upper cover 84 is formed to have a size which may cover the stepped portion 821 and the blocking rib 824, and an air path is formed between the upper surface of the stepped portion 821 and the upper cover 84.

Also, a rear end of the upper cover 84 extends further backward than the rear surface 83 of the control box 880 to form an exhaust port 801 between the rear surface 83 of the control box 80 and the upper cover 84. As a result, the air discharged through the outlet ports 822 may be easily discharged to the outside of the control box 80. Furthermore, rainwater may be prevented from being introduced into the control box 80 through the exhaust port 801.

The invention claimed is:

1. An outdoor unit of an air conditioner, comprising:

a case comprising:

a base pan configured to define a bottom surface;

an out panel coupled to be upright at an edge of the base pan; and a cover plate seated on an upper surface of the out panel and having a discharge port;

a control box accommodated in the case and installed at one side of a rear surface of the out panel;

a heat exchanger accommodated in the case;

a fan motor assembly accommodated in the case; and a compressor seated on the base pan, wherein the control box comprises:

a housing comprising left and right side surfaces, an upper surface and a rear surface, and of which a front surface and a lower surface are open;

a plurality of electrical components which are accommodated in the housing;

a stepped portion configured to extend further upward from the upper surface; and a plurality of outlet ports formed at the stepped portion.

2. The outdoor unit of claim 1, wherein the upper surface of the control box is formed to be inclined downward from a front end thereof toward a rear end thereof.

3. The outdoor unit of claim 2, further comprising a blocking rib which protrudes from a portion on the upper surface and extends in a widthwise direction, wherein the portion on the upper surface is corresponding to a position between the stepped portion and the front end of the upper surface of the control box.

4. The outdoor unit of claim 3, wherein a distance from the front end of the upper surface of the control box to a center of the blocking rib is shorter than a distance from the front end of the upper surface of the control box to an end of the blocking rib.

5. The outdoor unit of claim 3, further comprising a sleeve extending along an edge of each of the plurality of outlet ports to a predetermined height.

6. The outdoor unit of claim 5, further comprising an upper cover coupled to the upper surface and covering the blocking rib and the stepped portion.

7. The outdoor unit of claim 5, wherein a rear end of the upper cover extends further backward than the rear surface of the housing to form an exhaust port between the rear end of the upper cover and the rear surface of the housing.

8. The outdoor unit of claim 7, wherein the rear end of the upper cover is bent downward along the rear surface of the housing to direct the exhaust port to a lower end of the control box.

9. The outdoor unit of claim 1, further comprising:

at least one radiation hole formed at the left side surface or the right side surface of the housing;

a radiation plate installed at the at least one radiation hole; and a cooling pipe or a heat pipe seated on the radiation plate.

10. The outdoor unit of claim 9, wherein the cooling pipe comprises a refrigerant pipe in which two-phase refrigerant passed through an expansion valve flows.

11. The outdoor unit of claim 1, further comprising a service window formed by cutting away a part of the out panel, wherein the front surface of the control box is aligned with the service window.

12. The outdoor unit of claim 11, further comprising a service door which opens and closes the service window.

13. The outdoor unit of claim 1, further comprising an internal cover which covers the plurality of electrical components.

* * * * *